US010334387B2

(12) United States Patent
McGrath

(10) Patent No.: US 10,334,387 B2
(45) Date of Patent: Jun. 25, 2019

(54) AUDIO PANNING TRANSFORMATION SYSTEM AND METHOD

(71) Applicant: Dolby Laboratories Licensing Corporation, San Francisco, CA (US)

(72) Inventor: David S. McGrath, Rose Bay (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/738,529

(22) PCT Filed: Jun. 23, 2016

(86) PCT No.: PCT/US2016/039091

§ 371 (c)(1),
(2) Date: Dec. 20, 2017

(87) PCT Pub. No.: WO2016/210174

PCT Pub. Date: Dec. 29, 2016

(65) Prior Publication Data

US 2018/0184224 A1 Jun. 28, 2018

Related U.S. Application Data

(60) Provisional application No. 62/267,480, filed on Dec. 15, 2015, provisional application No. 62/184,351, filed on Jun. 25, 2015.

(51) Int. Cl.
*H04S 7/00* (2006.01)
*H04S 3/00* (2006.01)

(52) U.S. Cl.
CPC ..... *H04S 7/303* (2013.01); *H04S 3/008* (2013.01); *H04S 7/302* (2013.01);
(Continued)

(58) Field of Classification Search
CPC ..... H04S 7/302; H04S 7/303; H04S 3/008; H04S 2400/01; H04S 2400/11; H04S 2400/13
See application file for complete search history.

(56) References Cited

U.S. PATENT DOCUMENTS 9,807,538 B2 10/2017 McGrath
2005/0141728 A1 6/2005 Moorer
(Continued)

FOREIGN PATENT DOCUMENTS

CN 103618986 3/2014
EP 2451196 5/2012
(Continued)

OTHER PUBLICATIONS

Pulkki, Ville. "Uniform Spreading of Amplitude Panned Virtual Sources." 1999 IEEE Workshop on Applications of Signal Processing to Audio and Acoustics, Oct. 1999.*
(Continued)

*Primary Examiner* — James K Mooney

(57) ABSTRACT

A method of creating a multichannel audio signal by: determining an expected series of audio emission source locations around an expected listener location; determining a surface around the expected listener location, the surface including the expected series of audio emission source locations; mapping an audio object location into a surface energy component having a surface energy location and magnitude and an expected listener location energy component having an expected listeners location energy location and magnitude; panning an audio object signal for the surface energy component to surrounding expected audio emission sources to produce a first set of surface panned audio emission signals; panning the audio object signal for the expected listeners location energy location to surrounding expected audio emission sources to produce a second set
(Continued)

of expected listeners location panned audio emission signals; combining the first and second set of panned audio signals to produce the multichannel audio signal.

18 Claims, 13 Drawing Sheets

(52) U.S. Cl.
CPC ..... *H04S 2400/01* (2013.01); *H04S 2400/11* (2013.01); *H04S 2400/13* (2013.01)

(56) References Cited

U.S. PATENT DOCUMENTS

| | | | | |
|---|---|---|---|---|
| 2007/0269063 | A1 | 11/2007 | Goodwin | |
| 2012/0114152 | A1 | 5/2012 | Nguyen | |
| 2012/0155653 | A1 | 6/2012 | Jax | |
| 2013/0236039 | A1 | 9/2013 | Jax | |
| 2013/0329922 | A1* | 12/2013 | Lemieux | H04S 7/30 381/307 |
| 2014/0119581 | A1 | 5/2014 | Tsingos | |
| 2014/0133683 | A1 | 5/2014 | Robinson | |
| 2014/0219455 | A1 | 8/2014 | Peters | |
| 2015/0071447 | A1 | 3/2015 | Sen | |
| 2015/0081310 | A1 | 3/2015 | Keiler | |
| 2015/0117650 | A1* | 4/2015 | Jo | H04S 5/00 381/17 |
| 2015/0127354 | A1 | 5/2015 | Peters | |
| 2015/0163615 | A1 | 6/2015 | Boehm | |
| 2016/0066118 | A1* | 3/2016 | Oh | G10L 19/008 381/303 |

FOREIGN PATENT DOCUMENTS

| | | |
|---|---|---|
| WO | 2006/060607 | 6/2006 |
| WO | 2013/167164 | 11/2013 |
| WO | 2014/159272 | 10/2014 |
| WO | 2014/184706 | 11/2014 |
| WO | 2015/007889 | 1/2015 |
| WO | 2016/141023 | 9/2016 |

OTHER PUBLICATIONS

Klatzky, Roberta L. "Allocentric and Egocentric Spatial Representations: Definitions, Distinctions, and Interconnections" In: "Correct System Design" Springer International Publsihing, Jan. 1, 1998, vol. 1404, pp. 1-17.

Riedmiller, J. et al "Recent Advancements in Audio—How a Paradigm Shift in Audio Spatial Representation & Delivery Will Change the Future of Consumer Audio Experiences" May 21, 2015, pp. 3-5, Spring Technical Forum Proceedings.

Robinson, C. et al "Cinematic Sound Scene Description and Rendering Control" Annual Technical Conference & Exhibition, SMPTE Oct. 21, 2014, pp. 1-14.

Pulkki, V. "Virtual Sound Source Positioning Using Vector Base Amplitude Panning", Journal of the Audio Engineering Society, vol. 45, No. 6, Jun. 1, 1997, pp. 456-466.

Anonymous "Recommendation ITU-R BS Advanced Sound System for Programme Production BS Series Broadcasting Service Sound" Feb. 1, 2014.

* cited by examiner

AUDIO PANNING TRANSFORMATION SYSTEM AND METHOD

CROSS-REFERENCE TO RELATED APPLICATIONS

The present invention claims the benefit of U.S. Provisional Patent Application No. 62/184,351 filed on 25 Jun. 2015, and U.S. Provisional Patent Application No. 62/267,480 filed on 15 Dec. 2015, each of which are hereby incorporated by reference in their entirety.

FIELD OF THE INVENTION

The embodiments provide for an improved audio rendering method for rendering or panning of spatialized audio objects to at least a virtual speaker arrangement.

BACKGROUND OF THE INVENTION

Any discussion of the background art throughout the specification should in no way be considered as an admission that such art is widely known or forms part of common general knowledge in the field.

Panning systems for rendering spatialized audio are known. For example, the Dolby Atmos (Trade Mark) system provides for input spatialized audio to be rendered or panned between output audio emission sources so as to maintain some of the spatialization characteristics of the audio objects. Other known panning systems include the vector base amplitude panning system (VBAP).

SUMMARY OF THE INVENTION

It is an object of the invention to provide an improvement of panning operations for spatialized audio objects.

In accordance with a first aspect of the present invention, there is provided a method of creating a multichannel audio signal from at least one input audio object, wherein the input audio object preferably can include an audio object signal and an audio object location, the method including the steps of: (a) determining an expected series of audio emission source locations around an expected listener location; (b) determining a surface around the expected listener location, the surface including the expected series of audio emission source locations; (c) mapping the audio object location into a surface energy component having a surface energy location and magnitude and an expected listener location energy component having an expected listeners location energy location and magnitude; (d) panning the audio object signal for the surface energy component to surrounding expected audio emission sources produce a first set of surface panned audio emission signals; (e) panning the audio object signal for the expected listeners location energy location to surrounding expected audio emission sources to produce a second set of expected listeners location panned audio emission signals; (f) combining the first and second set of panned audio signals to produce an output set of panned audio signals as the multichannel audio signal.

The expected listener's location can be at a center of the surface. The step (e) can comprise panning the audio object signal to a left and right expected audio emission source. The panning in the step (e) preferably can include multiplying the audio object signal by predetermined gain factors. The expected listeners position can be substantially at a center of the enclosed volume of the surface. The surface can comprise substantially a sphere or rectangular block volume. The method can be applied to multiple input audio objects to produce an overall output set of panned audio signals as the multichannel audio signal.

In accordance with a further aspect of the present invention, there is provided a method for creating a multichannel audio signal from one or more input audio objects, where each audio object preferably can include an audio object signal and an audio object location, the method including, for at least one of the input audio objects, the steps of: (a) Determining a surface location associated with the audio object location, (b) Determining an origin distance metric indicative of the distance of the audio object location from a predetermined reference point (c) Determining a set of surface panning gains from the surface location according to a predefined panning function, (d) Processing the audio object signal with the surface panning gains, to produce a multi-channel surface-panned signal which is scaled according to the origin distance, (e) Scaling the audio object according to a scale factor derived from the origin distance, to produce a scaled origin signal, and processing the scaled origin signal, by a predetermined origin process, to produce a multi-channel origin panned signal, and (f) Combining the surface panned signal and the origin panned signal into the multichannel audio signal The origin process can produce the origin panned signal by processing the scaled origin signal by a predetermined set of origin panning gains In some embodiments, the origin panning gains are formed by: (a) Determining a set of left gains from the panning function based on a surface location that is substantially to the left of the reference point (b) Determining a set of right gains from the panning function based on a surface location that is substantially to the right of the reference point (c) Combining the left gains and right gains to form the origin panning gains In some embodiments, the origin process produces the origin panned signal by additionally processing the scaled origin signal by a decorrelation process, to produce a decorrelated origin signal, then applying a predetermined set of origin alternate gains to the decorrelated origin signal to produce an alternate origin panned signal, and combining the alternate origin panned signal with the origin panned signal In some embodiments the origin alternate gains are formed by: (a) Determining a set of left gains from the panning function based on a surface location that is substantially to the left of the reference point (b) Determining a set of right gains from the panning function based on a surface location that is substantially to the right of the reference point (c) Forming the difference between the left gains and right gains to form the origin alternate gains

BRIEF DESCRIPTION OF THE DRAWINGS

Embodiments of the invention will now be described, by way of example only, with reference to the accompanying drawings in which.

DETAILED DESCRIPTION

Embodiments provide for an improved audio rendering method for rendering or panning of spatialized audio objects to at least a virtual speaker arrangement. One embodiment has particular application in rendering the (speaker-based) Dolby Atmos objects. Whilst the embodiments are discussed with reference to the Dolby Atmos system, the present invention is not limited thereto and has application to other panning systems where audio panning is required.

The method of one embodiment is referred to as the "Solo-Mid Panning Method", and enables the spatialized audio objects (e.g. Dolby Atmos objects) to be rendered into Speaker-based and non-Speaker-based multi-channel panned formats.

Figure 1:
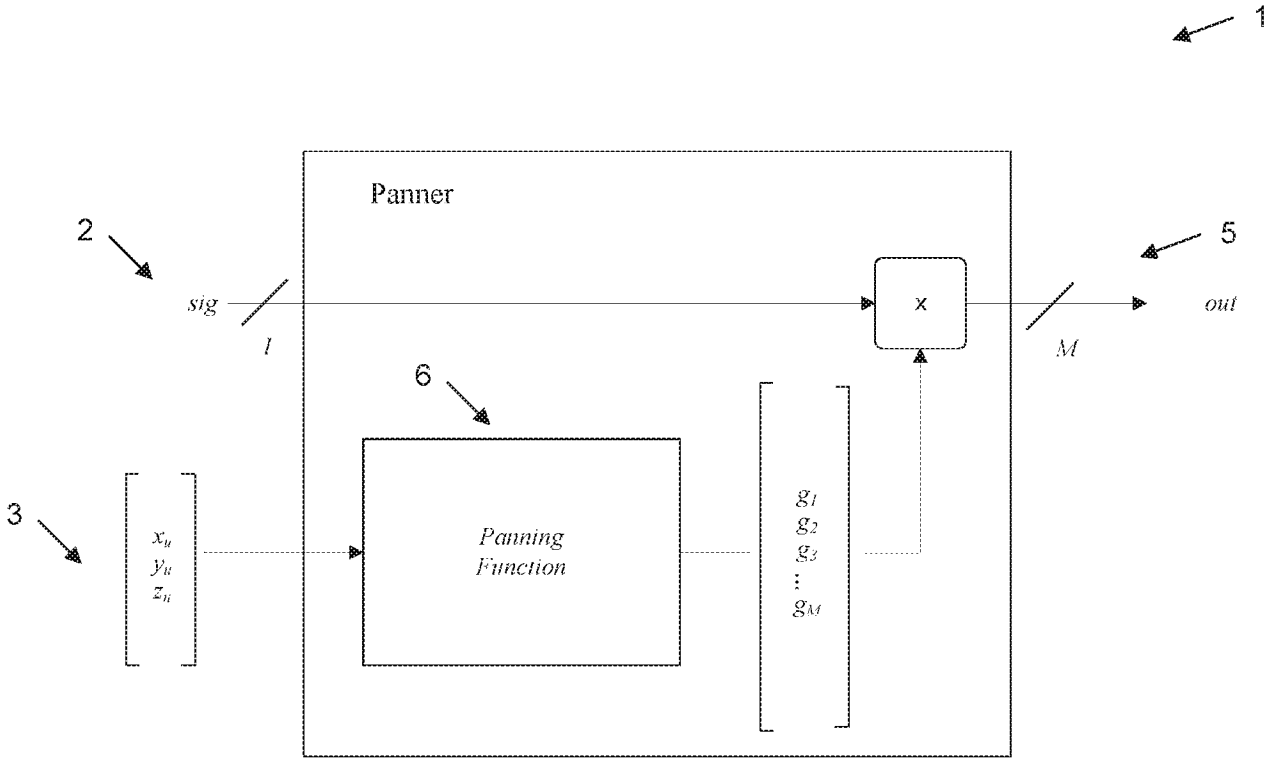
FIG. 1 illustrates schematically a panner composed of a Panning Function and a Matrix Multiplication Block

FIG. 1 initially illustrates the operation of a panner 1, which takes an audio input signal 2 and an intended location 3, designated in say (x,y,z) Cartesian coordinates and pans it to a set of M output audio channels 5 of intended speaker positions around a listener. A panner includes the following properties: It is provided with one audio input signal, sig; it is provided with a (time varying) input that indicates the "location" of the audio objects; Each output signal $out_m$ ($1 \le m \le M$) is equal to the input signal scaled by a gain factor, $g_m$, so that $out_m = sig \times g_m$; the gain factors, $g_m$, are functions of the "location".

In FIG. 1, the "location" is specified as a unit-vector, $(x_u, y_u, z_u)$, but (according to our broadest definition of a "panner") the location could potentially be defined in any abstract way (for example, the location could be defined by an integer value that corresponds to one of a finite set of "post-codes").

The Panner often makes use of a unit vector as the definition of "location" (this case will be referred to as a Unit-Vector Panner, in instances where there is a desire to emphasise this restriction). In other words, the panning function 6 can be defined as:

$$\begin{pmatrix} g_1 \\ g_2 \\ \vdots \\ g_M \end{pmatrix} = f(V_u) \ \{V_u \in R^3 \text{ and } |V_u| = 1\} \tag{1}$$

Generally, $V_u$ can be referred to in the form of a column vector:

$$V_u = \begin{pmatrix} x_u \\ y_u \\ z_u \end{pmatrix} \{x_u^2 + y_u^2 + z_u^2 = 1\} \tag{2}$$

Figure 2:
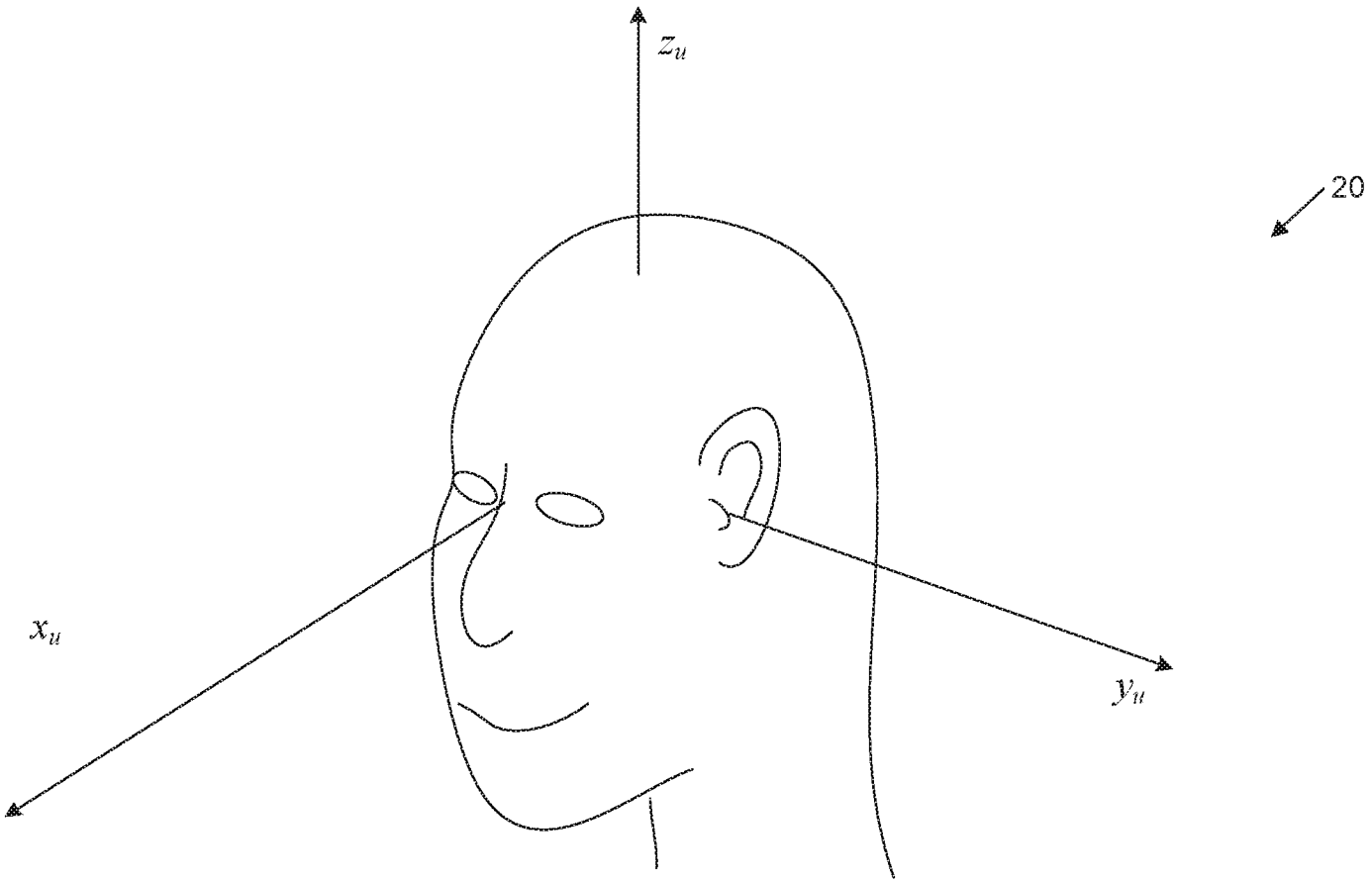
FIG. 2 illustrates the conventional coordinate system with a listener positioned at the origin.

FIG. 2 illustrates the concept of a spherical set of coordinates, suitable for use with a unit vector panning system. Unit-Vector Panners are an important sub-class of Panners, because many commonly used Panners are defined to operate only on Unit-Vector location input. Examples of unit vector panners include: Vector-Based Amplitude Panners (VBAP), and Higher-Order Ambisonic Panners.

Dolby Atmos Rendering Versus Unit-Vector Panning

Figure 3:
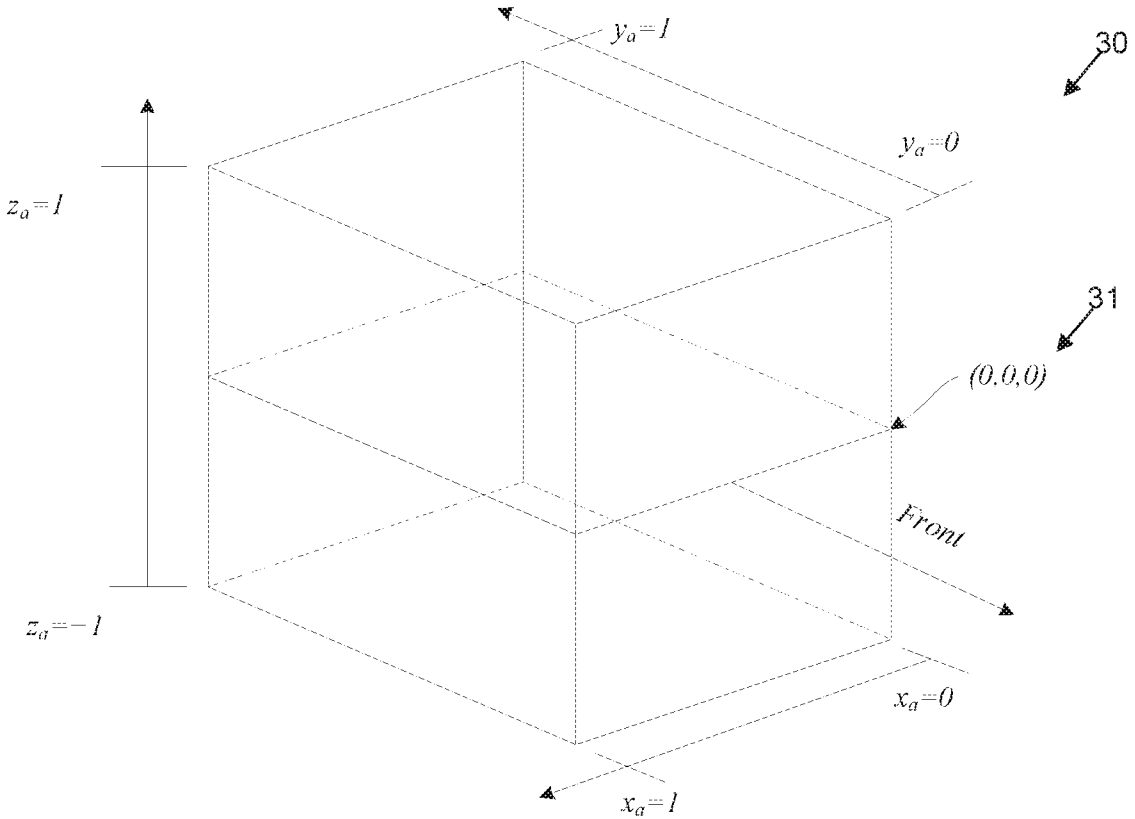
FIG. 3 illustrates the Dolby Atmos coordinate system.

As illustrated in FIG. 3, Dolby Atmos objects have a coordinate system location 30 where a location is defined in terms of the 3D coordinate system, $(x_a, y_a, z_a)$, where $x_a \in [0,1]$, $y_a \in [0,1]$ and $z_a \in [-1,1]$. The origin of the coordinate system is located at the point 31.

There are several practical implementation differences between the expected behaviour of a Dolby Atmos renderer, and the behaviour of a Unit-Vector Panner.

- A Dolby Atmos Renderer is defined in terms of the way it pans input audio objects to output speaker channels. In contrast, a Panner is permitted to produce outputs that might fulfil some other purpose (not necessarily speaker channels). Often, the output of a Panner is destined to be transformed/processed in various ways, with the final result often being in the form of speaker channels (or binaural channels).
- A Dolby Atmos Renderer is defined to operate according to panning rules that allow the $(x_a, y_a, z_a)$ coordinates to vary over a 3D range ($x_a \in [0,1]$, $y_a \in [0,1]$ and $z_a \in [-1,1]$). In contrast, the behaviour of a Unit-Vector Panner is normally only defined for coordinates $(x_u, y_u, z_u)$ that lie on the 2D surface of the unit-sphere.
- A Dolby Atmos object's location is defined in terms of its position within a listening space (for example, a cinema). In contrast, a Unit-Vector Panner makes use of objects that are "located" at a direction of arrival relative to the listener. The translation from a room-centric cinema format to a listener-centric consumer format is a difficult problem addressed by the present embodiment.
- A Dolby Atmos Renderer knows what speaker-arrangement is being used by the listener. In contrast, the Panner-based systems of the embodiments attempt to operate without specific prior knowledge of the playback system, because the output of the Panner can be repurposed to a particular playback environment at a later stage.

Figure 4:
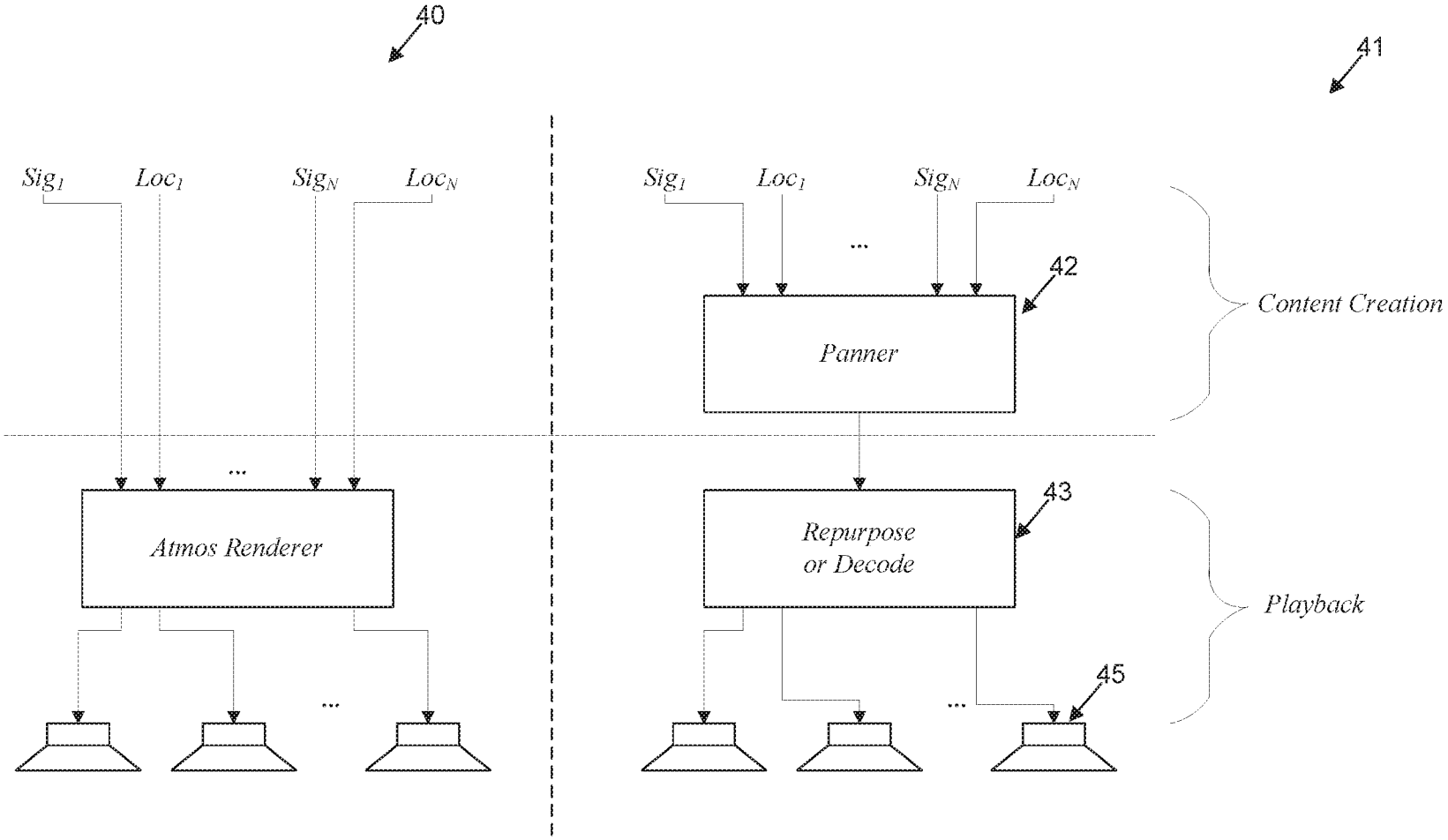
FIG. 4 illustrates schematically a comparison of a Dolby Atmos Render and a Panner/Decoder Methodology.

FIG. 4 illustrates the difference between a Dolby Atmos render 40 and a panning operation or panner 41. The typical use-case for a Panner-based content-delivery-chain is shown 41. The intention normally is to deliver the Panned signal 42 into an intermediate spatial format (ISF) which is then repurposed or decoded 43 for a particular output device or set of speakers 45. The operation of the panner can be undertaken off line, with the output separately distributed for playback on many different decoders 43.

In some cases, the intermediate Panned signal output by panner 42 is fit for direct listening on certain playback systems (for example, LtRt signals can be played back directly on stereo devices). However, in most cases, the intention is for the Panned intermediate signal to be "decoded" or "reformatted" 43 for playback on a speaker system (or headphones), where the nature of the playback system is not originally known to the Panner.

Whilst in most cases the Panner does not directly drive the speakers, it is often convenient to distort nomenclature and assume things like "the Panner will pan the audio object to the Left Back speaker", on the understanding that the decoder/reformatter will responsible for the final delivery of the sound to the speaker. This distortion of nomenclature makes it easier to compare the way a Panner-based system works vs a traditional Dolby Atmos renderer 40, which provides direct speaker outputs by pretending that both systems are driving speakers, even though the Panner is only doing part of the job.

Mapping a Dolby Atmos Cube to the Unit-Sphere

Given a $(x_a, y_a, z_a)$ location for an object in the Dolby Atmos Cube of FIG. 3, it is desirable to map this location to the Panner's unit sphere of FIG. 2. A method for converting the Dolby Atmos location to a point on the Unit-Sphere (plus an additional parameter indicating the "Atmos Radius" of the object) will now be described. Assuming, as input, the Atmos coordinates:

$$AtmosCoords = \begin{pmatrix} x_a \\ y_a \\ z_a \end{pmatrix}$$

where $0 \le x_a \le 1$, $0 \le y_a \le 1$, $-1 \le z_a \le 1$, it is desirable to compute the Map( ) function:

$$\begin{pmatrix} x_u \\ y_u \\ z_u \end{pmatrix} = \mathrm{Map}\left(\begin{pmatrix} x_a \\ y_a \\ z_a \end{pmatrix}\right)$$

by the process as follows:

1. Begin by shifting the Atmos Coordinates, to put the origin in the centre of the room, and scale the coordinates so that they are all in the range [−1,1], as follows:

$$\begin{pmatrix} x_s \\ y_s \\ z_s \end{pmatrix} = \begin{pmatrix} 1 - 2y_a \\ 1 - 2x_a \\ z_a \end{pmatrix}$$

2. Construct a line from the origin (the centre of the unit-cube), through the point $(x_s, y_s, z_s)$, and determine the point $(x_p, y_p, z_p)$, where this line intersects the walls of the unit-cube. Also, compute the "Atmos Radius", which determines how far the point $(x_s, y_s, z_s)$ is from the origin, relative to the distance to $(x_p, y_p, z_p)$. Many methods of determining a distance between two points will be evident to one of ordinary skill in the art, any of which may be used to determine the Atmos Radius. One exemplary form of measurement can be:

$$AtmosRadius = \max(|x_s|, |y_s|, |z_s|)$$

$$\begin{pmatrix} x_p \\ y_p \\ z_p \end{pmatrix} = \frac{1}{AtmosRadius}\begin{pmatrix} x_s \\ y_s \\ z_s \end{pmatrix}$$

3. Next, the cube can be deformed to form a cylinder (expressed in cylindrical coordinates, (r, ϕ, z)), and we may also distort the radius with the sine function to "encourage" objects in the ceiling to stick closer to the edges of the room:

$$\begin{pmatrix} r_c \\ \phi_c \\ z_c \end{pmatrix} = \begin{pmatrix} \max(|x_p|, |y_p|) \\ \arctan(y_p, x_p) \\ z_s \end{pmatrix}$$

or (applying the optional sine distortion):

$$\begin{pmatrix} r_c \\ \phi_c \\ z_c \end{pmatrix} = \begin{pmatrix} \sin\left(\frac{\pi}{2}\max(|x_p|, |y_p|)\right) \\ \arctan(y_p, x_p) \\ z_s \end{pmatrix}$$

The arc tan function used here takes 2 args, as defined by the Matlab a tan 2 function.

4. There is a need to account for the possibility that the Unit-Vector Panner might prefer to place particular default speaker locations at specific azimuths. It is therefore assumed that a Warp( ) function is provided, which changes only the azimuths:

$$\phi_{panner} = \mathrm{Warp}(\phi_c, z_c)$$

This Warp function makes use of the $z_c$ coordinate, as it may choose to apply a different azimuth warping for locations at z=0 (at ear-level), compared to z=1 (on the ceiling) of z=1 (on the floor).

5. Finally, the point $(r_c, \phi_{panner}, z_c)$ which still lies on the surface of the cylinder, is projected to the unit-sphere:

$$\begin{pmatrix} x_u \\ y_u \\ z_u \end{pmatrix} = \frac{1}{\sqrt{r_c^2 + z_c^2}}\begin{pmatrix} r_c\cos\phi_{panner} \\ r_c\sin\phi_{panner} \\ z_c \end{pmatrix}$$

The process above implements a Map( ) function, allowing Dolby Atmos coordinates to be converted to Unit-Vector coordinates. At Step 4, a Warp( ) function is called, which provides a means for altering the azimuth of the object. More details of this Warp( ) function are given below. The Map( ) function also computes a term called AtmosRadius, and this term will also be used by methods, such as the "Solo-Mid Panning Method", also described below.

The Warp( ) Function

The choice of a particular multi-channel soundfield format can involve the choice of a Unit-Vector Panner and a Warp( ) function. For example, an Ambisonics audio format can be defined by the use of an Ambisonics Panner along with the $\mathrm{Warp}_{ITU}$( ) warping function (which will map the Left Channel, which appears in the front left corner of the Dolby Atmos cube, at 45°, to the standard Left-channel angle of 30°).

Preferably, any Warp( ) function used in practical applications should also have an easily computed inverse function, $\mathrm{Warp}^{-1}$( ).

One possible method for implementing a Warp( ) function is as follows. Given inputs $\phi_c$ and $z_c$, the $\mathrm{Warp}_{ITU}$( ) function computes $\phi_{panner} = \mathrm{Warp}_{ITU}(\phi_c, z_c)$ by the following steps:

1. Starting with a table of 6 constants that define the behaviour of the Warp( ) function as follows:

$\Phi_{M,F}$=30, the warped azimuth for the ear-level front-left channel;

$\Phi_{M,B}$=150, the warped azimuth for the ear-level back-left channel;

$\Phi_{U,F}$=45, the warped azimuth for the upper front-left channel;

$\Phi_{U,B}$=135, the warped azimuth for the upper back-left channel;

$\Phi_{L,F}$=45, the warped azimuth for the lower front-left channel;

$\Phi_{L,B}$=135, the warped azimuth for the lower back-left channel.

2. Three "elevation weighting" coefficients can be defined as follows:

$$w_{up}=\max(0,z_c) \tag{3}$$

$$w_{down}=\max(0,-z_c) \tag{4}$$

$$w_{mid}=1-|z_c| \tag{5}$$

These coefficients satisfy the rule: $w_{up}+w_{down}+w_{mid}=1$ for all permissible values of $z_c$ between −1 and +1.

3. Now, the warped azimuth angles can be defined for the elevation:

$$\Phi_F=w_{mid}\Phi_{M,F}+w_{up}\Phi_{U,F}+w_{down}\Phi_{L,F} \tag{6}$$

$$\Phi_B=w_{mid}\Phi_{M,B}+w_{up}\Phi_{U,B}+w_{down}\Phi_{L,B} \tag{7}$$

4. And finally, the new azimuth can be computed as a piecewise linear function (here, the nomenclature uses the Matlab interp1 function):

$$\phi_{panner}=\text{interp1}([-180,-135,-45,45,135,180], \tag{8}$$

$$[-180,-\Phi_B,-\Phi_F,\Phi_F,\Phi_B,180],\phi c) \tag{9}$$

or, alternatively, we may apply the warping such that the 90-degree angles are also preserved:

$$\phi_{panner}=\text{interp1}([-180,-135,-90,-45,45,135,180], \tag{8a}$$

$$[-180,-\Phi_B,-90,-\Phi_F,\Phi_F,90,\Phi_B,180],\phi c) \tag{9a}$$

By way of an example, an object at 45° azimuth (the front right corner of the Dolby Atmos square) will be mapped to a new azimuth angle: $-\Phi_F$, where $\Phi_F$ is derived as a piecewise-linear mixture of $\Phi_{M,F}$, $\Phi_{U,F}$ and $\Phi_{L,F}$, dependant on the elevation (z-coordinate) of the object.

Figure 6:
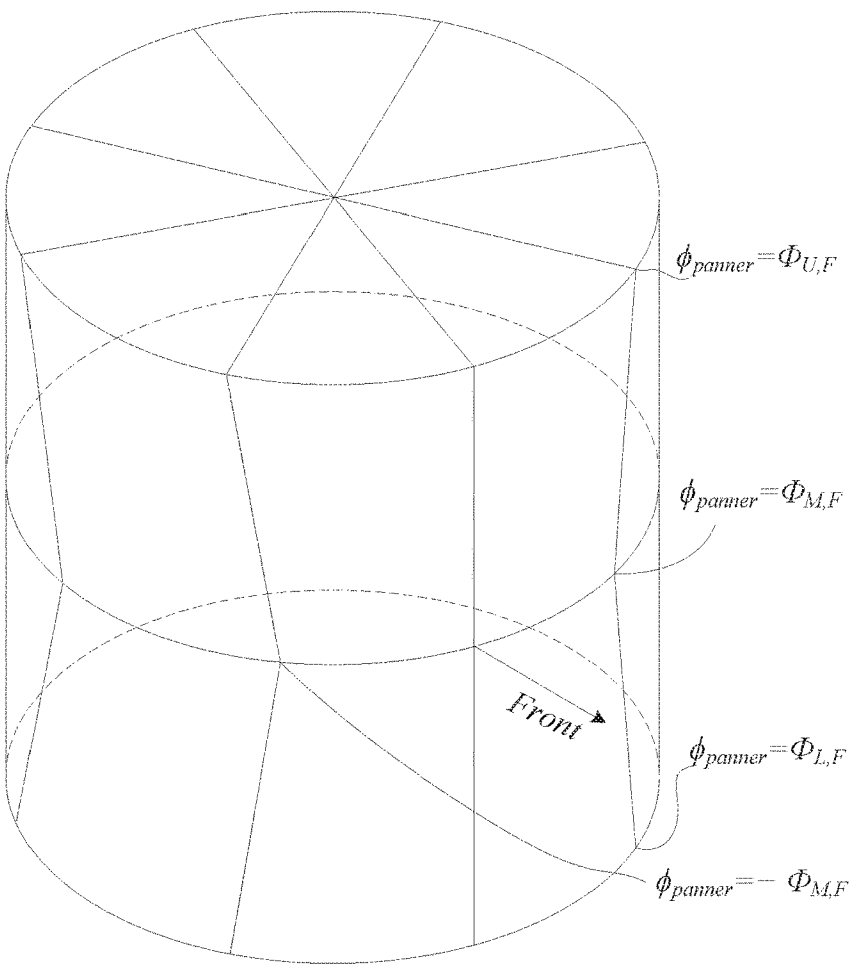
FIG. 6 illustrates the corresponding azimuth angles for different heights on a warped cylinder.
Figure 5:
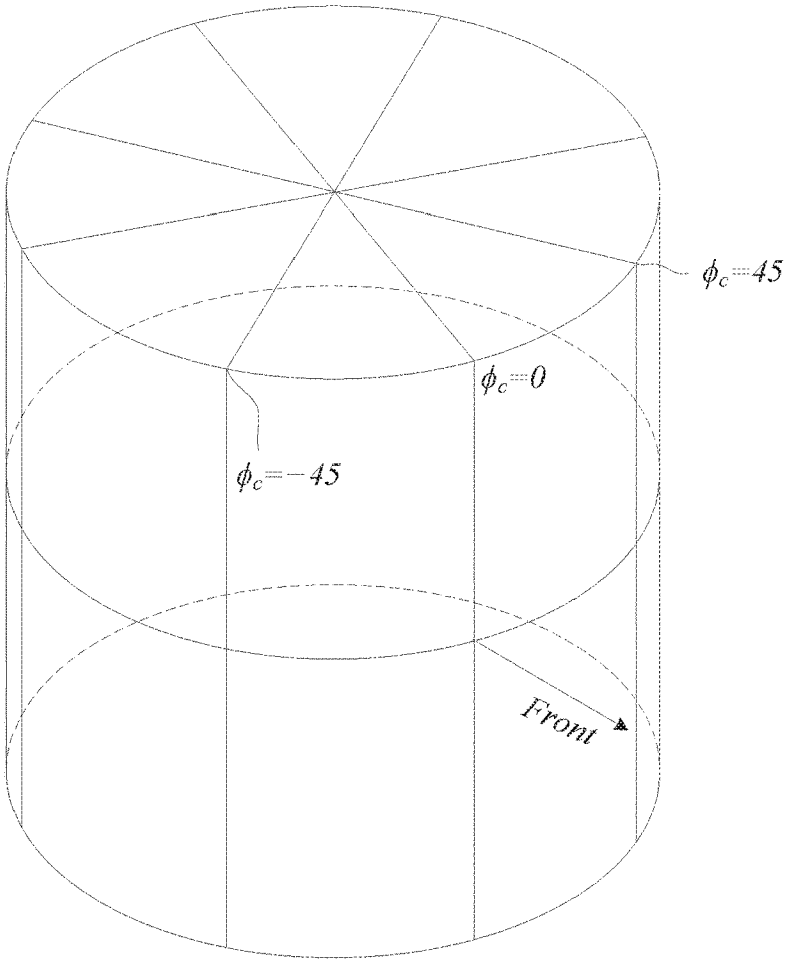
FIG. 5 illustrates the azimuth angles at different heights on the cylinder.

The operation of the warping, on the surface of the cylinder, is shown in FIG. 5 and FIG. 6 FIG. 5 illustrates the unwarped cylindrical coordinate mapping whereas FIG. 6 illustrates the warped cylindrical mapping.

More than one possible warping function can be defined, depending on the application. For example, when we are intending to map the location of Atmos objects onto the unit-sphere, for the purpose of panning the objects to a 2-channel "Pro Logic" signal, the panning rules will be different, and we will make use of a warping function that we refer to as $\text{Warp}_{PL}(\,)$ Each warping function is defined by the choice of the six warping constants. Typical values for the warping constants are shown in the following Table which shows Warping azimuths for different Atmos to Unit-vector transformations.

| | label | base | $\text{Warp}_{PL}(\,)$ | $\text{Warp}_{ISF}(\,)$ | $\text{Warp}_{ITU}(\,)$ |
|---|---|---|---|---|---|
| $\Phi_{M,F}$ | FL | 45 | 90 | 51.4 | 30 |
| $\Phi_{M,B}$ | BL | 135 | 162 | 154.3 | 150 |
| $\Phi_{U,F}$ | TpFL | 45 | 72 | 45 | 45 |
| $\Phi_{U,B}$ | TpBL | 135 | 144 | 135 | 135 |

-continued

| | label | base | $\text{Warp}_{PL}(\,)$ | $\text{Warp}_{ISF}(\,)$ | $\text{Warp}_{ITU}(\,)$ |
|---|---|---|---|---|---|
| $\Phi_{L,F}$ | BtFL | 45 | 72 | 72 | 45 |
| $\Phi_{L,B}$ | BtBL | 135 | 144 | 144 | 135 |

By way of example, suppose that an object is located in Dolby Atmos coordinates at (0,0,1/2). Then, the Dolby Atmos coordinates will be mapped to the cylindrical coordinates: $z_c$=½, $r_c$=1 and $\phi_c$=45°. If it is intended to pan the audio object into an Ambisonics signal, we may wish to first warp the azimuth angle according to the ITU warping rules (as per the column headed $\text{Warp}_{ITU}(\,)$ in Table 1). According to this table, an object at $\phi$=45°, will be mapped to 30° if it lies on the middle plane (at z=0), and it will be mapped to 45° if it lies on the upper plane (at z=1). Hence, being located half-way between these planes, at $z_c$=½, it will be mapped to 37.5° (since this is the average of 30 and 45). In other words, WarpITU(45°,0.5)=37.5°.

Inverse Mapping Functions

The Mapping function (Map( ) is invertible, and it will be appreciated that an inverse function may be readily implemented. The inverse function, $\text{Map}^{-1}(\,)$, will also include the use of an inverse warping function (note that the Warp( ) function is also invertible). It will also be appreciated that the output of the Map( ) function may also be expressed in Spherical Coordinates (in terms of Azimuth and Elevation angles, and radius), according to well known methods for conversion between cartesian and spherical coordinate systems. Likewise, the inverse function, $\text{Map}^{-1}(\,)$, may be adapted to take input that is expressed in terms of Spherical coordinates (in terms of Azimuth and Elevation angles, and radius).

By way of example, an inverse mapping function is described, which converts from a point that lies on, or inside, the unit sphere, to a point, represented in Atmos-coordinates, that lies on, or inside the Atmos-cube. In this example, the input to the mapping function is defined in Spherical Coordinates, and the inverse mapping function is defined as follows:

$$\begin{pmatrix} x_a \\ y_a \\ z_a \end{pmatrix} = Map^{-1}\left(\begin{pmatrix} \phi_s \\ \theta_s \\ r_s \end{pmatrix}\right)$$

The procedure for implementation of this inverse mapping function is as follows:

Step 1. Input is provided in the form of an Azimuth angle ($\phi_s$), an Elevation angle ($\theta_s$) and a radius ($r_s$).

Step 2. Modify the elevation angle, so that 30° elevation is mapped to 45°:

$$\theta_w = \begin{cases} \frac{3}{2}\theta_s & |\theta_s| \le 30° \\ 90 - \frac{3}{4}(90-\theta_s) & \theta_s > 30° \\ -90 - \frac{3}{4}(-90-\theta_s) & \theta_s < -30° \end{cases}$$

Step 3. Unwarp the azimuth angle:

$$\phi_w=\text{Warp}^{-1}(\phi_s)$$

Step 4. Map the modified azimuth and elevation angles onto the surface of a unit-sphere:

$$x_s = \sin \phi_w \cos \theta_w$$

$$y_s = \cos \phi_w \cos \theta_w$$

$$z_s = \sin \theta_w$$

Step 5. Distort the sphere into a cylinder:

$$\text{scale}_{cyl} = \frac{1}{\max\left(|z_s|, \sqrt{x_s^2 + y_s^2}\right)}$$

$$x'' = x_s \times \text{scale}_{cyl}$$

$$y'' = y_s \times \text{scale}_{cyl}$$

$$z'' = z_s \times \text{scale}_{cyl}$$

Step 6. Distort the cylinder into a cube (by scaling the (x,y) coordinates), and then apply the radius:

$$\text{scale}_{cube} = \frac{1}{\max(|\sin\phi_w|, |\cos\phi_w|)}$$

$$X = x'' \times r_s \times \text{scale}_{cube}$$

$$Y = y'' \times r_s \times \text{scale}_{cube}$$

$$Z = z'' \times r_s$$

Step 7. Shift the unit cube onto the Atmos cube, in terms of the coordinates $x_a$, $y_a$ and $z_a$:

$$x_a = \frac{X+1}{2}$$

$$y_a = \frac{Y+1}{2}$$

$$z_a = Z$$

In the preceeding description the azimuth inverse-warping is used: $\phi_w = \text{Warp}^{-1}(\phi_s)$. This inverse warping may be performed using the procedure described above (for the Warp( ) function), wherein equations (8a) and (9a) are replaced by the following (inverse) warping equation:

$$\phi_w = \text{interp1}([-180, -\Phi_B, -90, -\Phi_F, 0, \Phi_F, 90, \Phi_B, 180],$$

$$[-180, -135, -90, -45, 0, 45, 90, 135, 180], \phi_s)$$

or, alternatively, wherein equations (8) and (9) are replaced by the following (inverse) warping equation, such that the 90-degree angles are not preserved:

$$\phi_w = \text{interp1}([-180, -\Phi_B, -\Phi_F, 0, \Phi_F, \Phi_B, 180],$$

$$[-180, -135, -45, 0, 45, 90, 135, 180], \phi_s)$$

The Solo-Mid Panning Method

A Dolby Atmos renderer normally operates based on its knowledge of the playback speaker locations. Audio objects that are panned "on the walls" (which includes the ceiling) will be rendered by an Atmos renderer in a manner that is very similar to vector-based-amplitude panning (but, where VBAP uses a triangular tessellation of the walls, Dolby Atmos uses a rectangular tessellation).

In general, it could be argued that the sonic differences between different panning methods are not a matter of artistic choice, and the primary benefit of the Dolby Atmos panning rules is that the rules are readily extended to include behaviour for objects that are panned away from the walls, into the interior of the room.

Assuming, for a moment, that a Unit-Vector Panner, f( ) is used that provides some kind of desired useful panning functionality. The problem is that, whilst such a panner is capable of panning sounds around the surface of the unit-sphere, it has no good strategy for panning sounds "inside the room". The Solo-Mid Panning Method provides a methodology for overcoming this issue.

The Solo-Mid Panning Method is a process that takes a Dolby Atmos location $(x_a, y_a, z_a)$ and attempts to render an object according to the Dolby Atmos panning philosophy, whereby the rendering is done via a Unit-Vector Panner, rather than to speakers.

Figure 7:
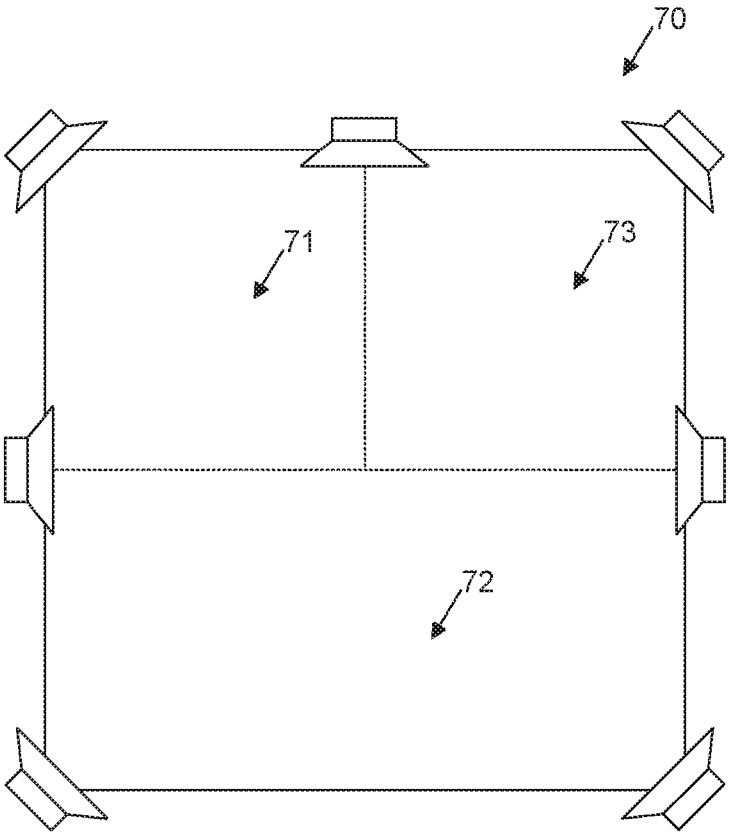
FIG. 7 illustrates the form of tessellation used in Dolby Atmos.

FIG. 7 illustrates a top view 70 of the ear-level plane ($z_a$=0) in the Dolby Atmos coordinate system. This square region is broken in rectangular tiles 71, 72, 73, where the tiling is performed based on the location of the speakers along the sides of the "Dolby Atmos square".

Figure 8:
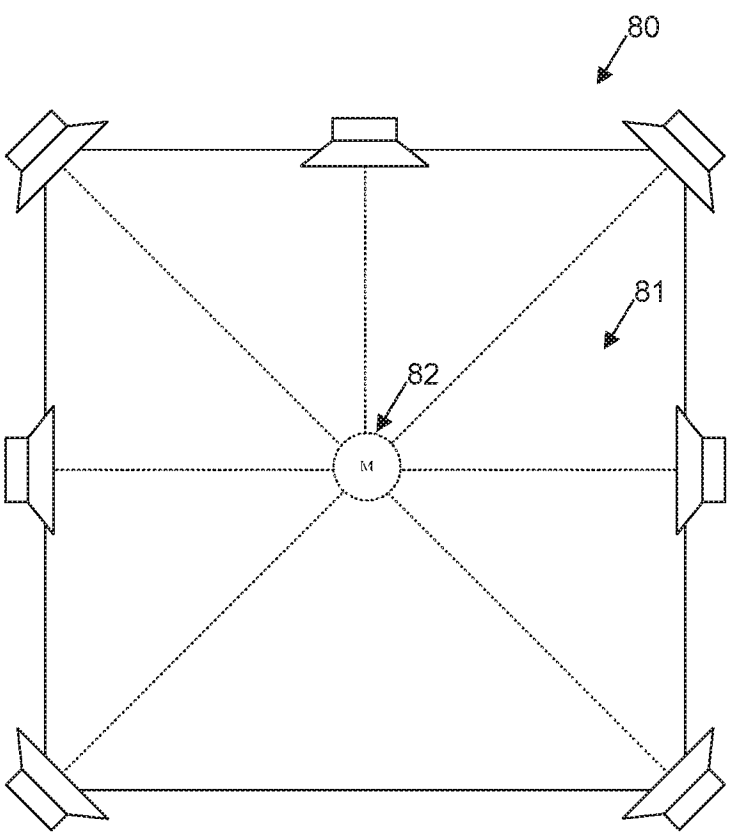
FIG. 8 illustrates the form of radial tessellation.

An alternative strategy, as shown in FIG. 8, according to the Solo-Mid Manning Method, is to break the Dolby Atmos Square into triangular regions e.g. 81. The triangular tessellation works on the assumption that there is a strategy for handling the Solo-Mid location 82 (the spot marked M in the centre of the room). The benefit of this triangular tessellation is that the lines dividing the tiles are all radial from the centre of the room (the Solo-Mid location). Of course, the Panner does not really know where the playback speakers will be located, so the tessellation can be thought of as a more abstract concept.

Figure 9:
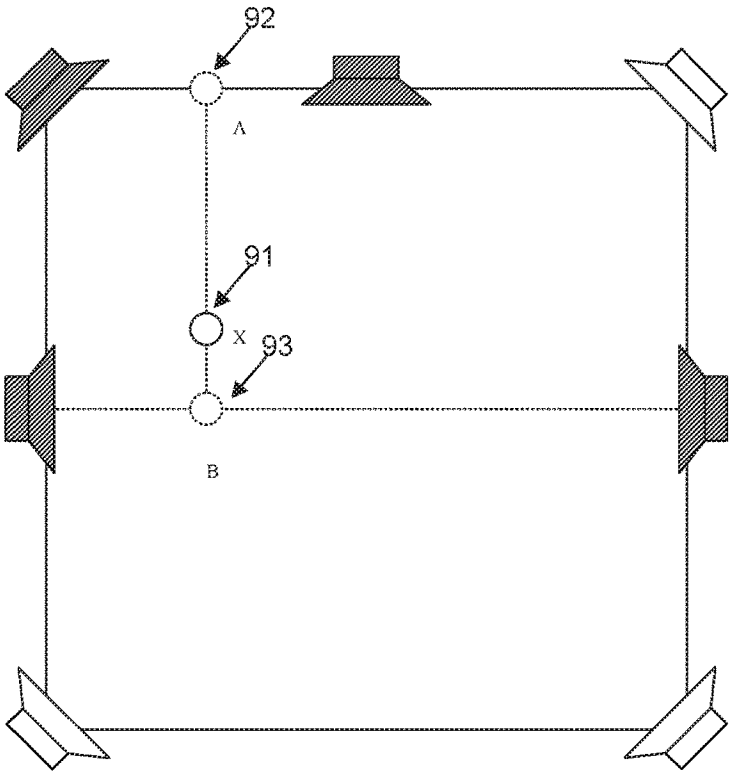
FIG. 9 illustrates the panning operation in Dolby Atmos, whilst

Specifically, by way of example, FIG. 9 shows an object (labelled X) 91 that is panned to (0.25, 0.375, 0) in Dolby Atmos coordinates. FIG. 9 shows the Dolby Atmos panner in action, creating the panned image of the object (X) by creating intermediate "phantom objects" A 92, and B 93. The following panning equations are simplified, to make the maths look neater, as the real equations involve trig functions:

$$X \rightarrow 0.25A + 0.75B$$

$$A \rightarrow 0.5L + 0.5C$$

$$B \rightarrow 0.75Ls + 0.25Rs$$

$$\therefore X \rightarrow 0.125L + 0.125C + 0.5625Ls + 0.1825Rs$$

The mixture of four speakers, to produce the Dolby Atmos object (X), is all carried out inside the Dolby Atmos renderer, at playback time, so that the object is directly panned to the four speakers.

Figure 10:
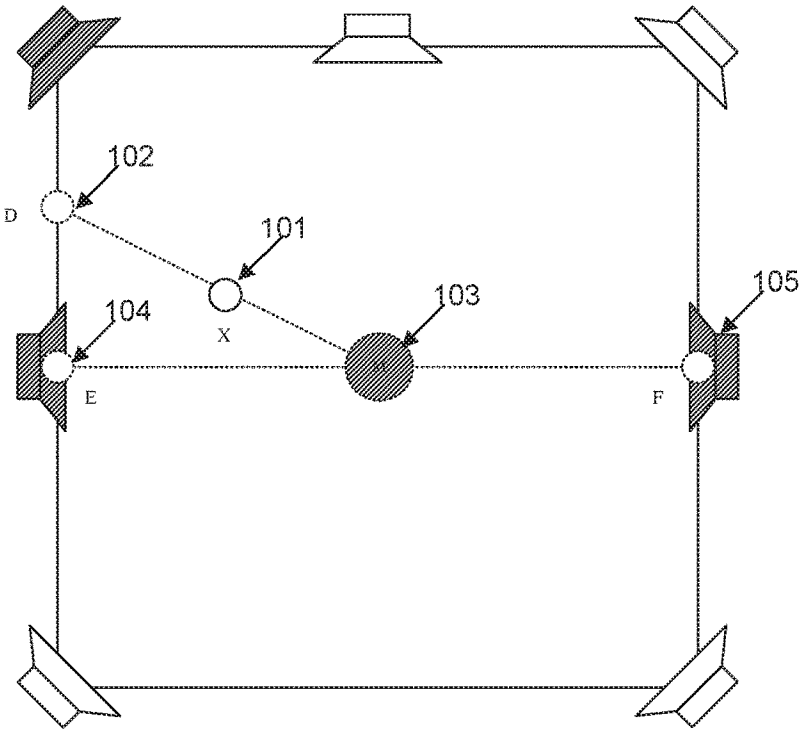
FIG. 10 illustrates the panning operation of an embodiment.

Turning to FIG. 10, there is illustrated the corresponding Solo-Mid Panner production chain. This process produces an image of the Dolby Atmos object (X) by a two-stage process.

Step 1: The Panner:

The Panner/encoder forms the image of the object (X) 101 by creating two phantom objects, D 102 and M 103, where M represents an object in the centre of the room. This process is performed by the above discussed Map( ) function: $[(x_D, y_D, z_D), \text{AtmosRadius}_D] = \text{Map}(0.25, 0.375, 0)$, which gives the Unit-Vector for phantom object D $(x_D, y_D, z_D)$, as well as $\text{AtmosRadius}_D = 0.5$ for the object.

Then, in the simplest kind of Solo-Mid Panner, the phantom object M 103 can in turn be formed by two phantom objects, E and F. Some radial warping can be applied to the panning function, by squaring the distance from the wall:

$$\text{DistFromWall}=(1-\text{AtmosRadius}_D)^2$$

$$X\rightarrow(1-\text{DistFromWall})\times D+\text{DistFromWall}\times M$$

$$\rightarrow 0.75D+0.25M$$

$$M\rightarrow 0.5E+0.5F$$

$$\therefore X=0.75D+0.125E+0.125F$$

In a simplified version of the method, the M×1 Gain Vector for the M channel might be formed from a mixture of gain vectors for the Dolby Atmos positions on the left and right walls (where the Ls and Rs speakers normally sit):

$$G_{SM}=\tfrac{1}{2}(f(\text{Map}(0,0.5,0))+f(\text{Map}(1,0.5,0))) \quad (10)$$

and the Gain Vector for the panned object D 102 will be:

$$G_D=f(\text{Map}(0,0.25,0)) \quad (11)$$

Hence, the Solo-Mid Panned signals will render the object X according to the M×1 Gain Vector:

$$G_X=(1-\text{DistFromWall})\times G_D+\text{DistFromWall}\times G_{SM} \quad (12)$$

Step 2: The Decoder.

The phantom objects D (102), E (104) and F (105) can be "baked in" to the Panned signals by the Unit-Vector Panner. The decoder has the job of taking the Panned signals and rendering these signals to the available speakers. The decoder can therefore (ideally) place the three phantom objects D, E and F approximately as follows:

$$D\rightarrow 0.5L+0.5Ls$$

$$E\rightarrow Ls$$

$$F\rightarrow Rs$$

The final result, from the combination of the encoder and the decoder, is as follows:

$$X\rightarrow 0.75D+0.125E+0.125F$$

$$\rightarrow 0.375L+0.5Ls+0.125Rs$$

The table below shows a comparison of the gains for the atmos and solo mid panning process:

| Speaker | Gain (Dolby Atmos) | Gain (Solo-Mid) |
|---|---|---|
| L | 0.125 | 0.375 |
| R | 0 | 0 |
| C | 0.125 | 0 |
| Ls | 0.5625 | 0.5 |
| Rs | 0.1825 | 0.125 |
| Lb | 0 | 0 |
| Rb | 0 | 0 |

The Table shows the theoretical gains for the Dolby Atmos and Solo-Mid pans. This represents a slightly simplified example, which assumes that the conversion from the Solo-Mid Panned signal to speaker signals is ideal. In this simple example, the gains were all formed using a linear (amplitude preserving) pan. Further alternative panning methods for the Solo-Mid Method will be described below (and the Dolby Atmos panner may be built to be power-preserving, not amplitude preserving).

Using Decorrelation to Render the Solo-Mid Channel

The Solo-Mid Channel (the phantom position at location M 103 in FIG. 10) may be rendered by a variety of techniques. One option is to use decorrelation to spread sound to the LeftSide and RightSide locations (at the positions where the Ls and Rs speakers are expected to be).

Assuming there are two decorrelators, $D_L$ and $D_R$, both of which are approximately unity-gain. Then, the Solo-Mid panning function can be defined to be:

$$G_{SM}=\frac{1}{\sqrt{2}}(D_L\times f(\text{Map}(0,0.5,0))+D_R\times f(\text{Map}(1,0.5,0))) \quad (13)$$

The new version of the Solo-Mid channel will be decorrelated from the D phantom image 102 (the projection of the object X 101 onto the walls for the room). Hence, the rendering of X 101 as a mixture of D and M can be done with a power-preserving pan:

$$G_X=\sqrt{1-\text{DistFromWall}}\times f(\text{Map}(0.25,0.375,0))+\sqrt{\text{DistFromWall}}\times G_{SM} \quad (14)$$

Alternative Panning Laws

In the previous section, different approaches were shown for the creation of $G_{SM}$ (the Gain Vector used to pan to the Solo-Mid position M 103). One approach used decorrelation, and as a result, the mixture of the two phantom objects (at Dolby Atmos locations (0,0.5,0) and (1,0.5,0)) was carried out using gain factors of $$\frac{1}{\sqrt{2}}.$$

If the Gain Vectors for these two Dolby Atmos locations, (0,0.5,0) and (1,0.5,0), are correlated in some way, the sum of the two vectors will require some post-normalisation, to ensure that the resulting gain vector, $G_{SM}$ has the correct magnitude.

The original (non-decorrelating) method for forming the phantom image for the Solo-Mid channel, as per Equation 11, can be varied as follows:

$$G_{Ls}=f(\text{Map}(0,0.5,0)) \quad (15)$$

$$G_{Rs}=f(\text{Map}(1,0.5,0)) \quad (16)$$

$$tmp=G_{Ls}+G_{Rs} \quad (17)$$

$$G_{SM}=tmp\times\sqrt{\frac{|G_{Ls}|^2+|G_{Rs}|^2}{2|tmp|^2}} \quad (18)$$

This slightly more complex method for computing $G_{SM}$ provides for a better result, in most cases. As $G_{SM}$ needs to be computed only once, there is no problem with the computation being complicated.

Looking at the way the phantom image X is formed, as a mixture of Gain Vectors $G_D$ and $G_{SM}$, it is possible to generalise the panning rule to choose between constant-power or constant-amplitude panning with the parameter, p:

$$G_X=G_D\times(1-\text{DistFromWall})^P+G_{SM}\times\text{DistFromWall}^P \quad (19)$$

where p=1 when it is known that the gain vectors $G_1$ and $G_2$ are highly correlated (as assumed in Equation 11), and p=½ when it is known that the gain vectors are totally decorrelated (as per Equation 13). In practice, when the Gain Vectors are only partly correlated, or when it is not known how correlated they are, a compromised choice can be $$p = \frac{1}{\sqrt{2}}.$$

The new variant of Equations 12 and 14 can be as follows:

$$G_X = (1-\text{DistFromWall})^{0.707} \times f(\text{Map}(0.25, 0.375, 0)) + \text{DistFromWall}^{0.707} \times G_{SM} \quad (20)$$

Example Implementations—Spherical Panning

Figure 11:
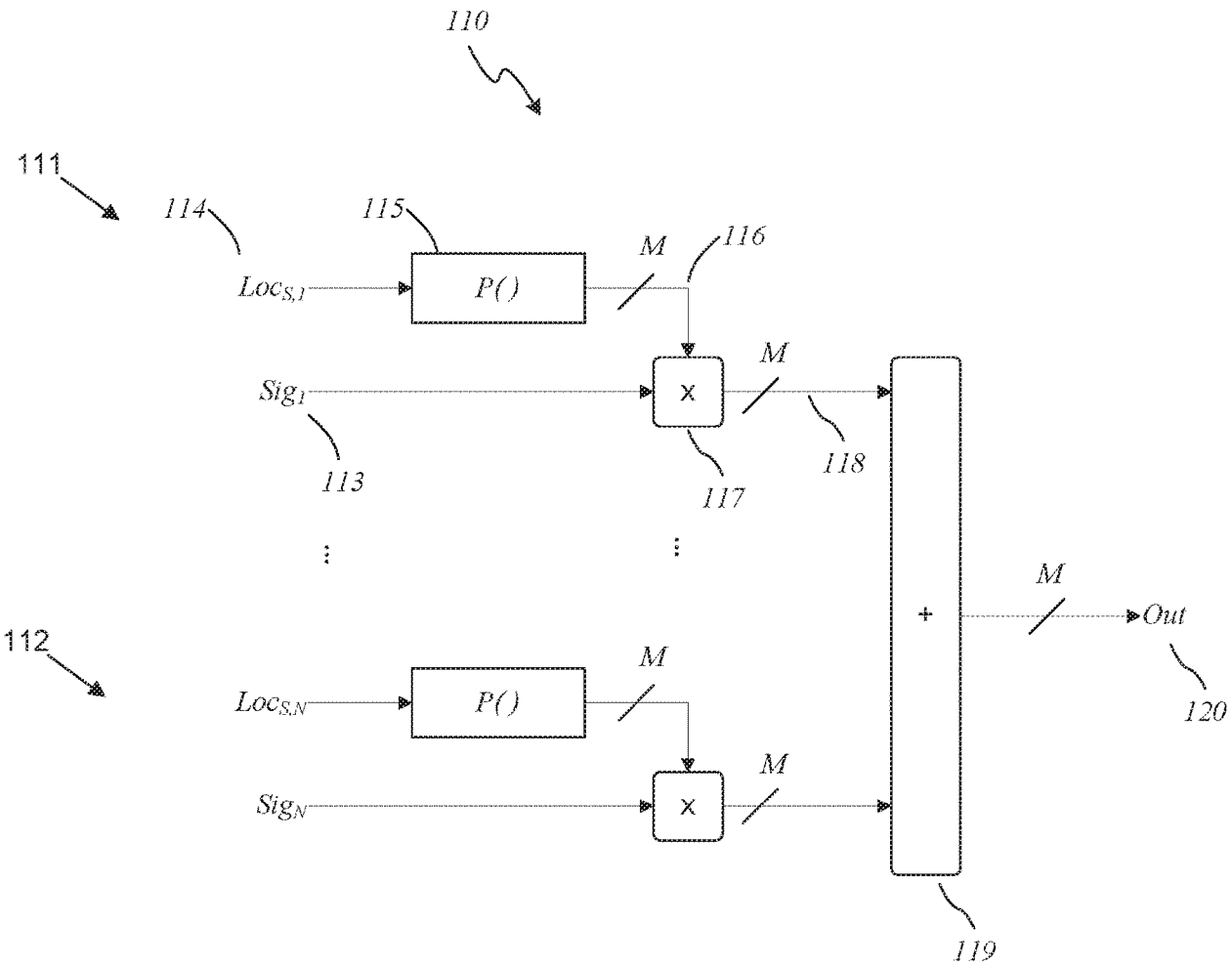
FIG. 11 illustrates a basic panning operation of producing M speaker outputs.

FIG. 11 illustrates 110 an example arrangement for panning objects to M speaker outputs, where the objects to be panned are panned to the surface of a sphere around a listener. In this arrangement 110, a series of input audio objects e.g. 111, 112 each contain location 114 and signal level data 113. The location data is fed to a panner 115 which maps the Dolby Atmos to Spherical coordinates and produces M output signals 116 in accordance with the above Warping operation. These outputs are multiplied 117 with the reference signal 113 to produce M outputs 118. The outputs are summed 119 with the outputs from other audio object position calculations to produce an overall output 120 for output for the speaker arrangement.

Figure 12:
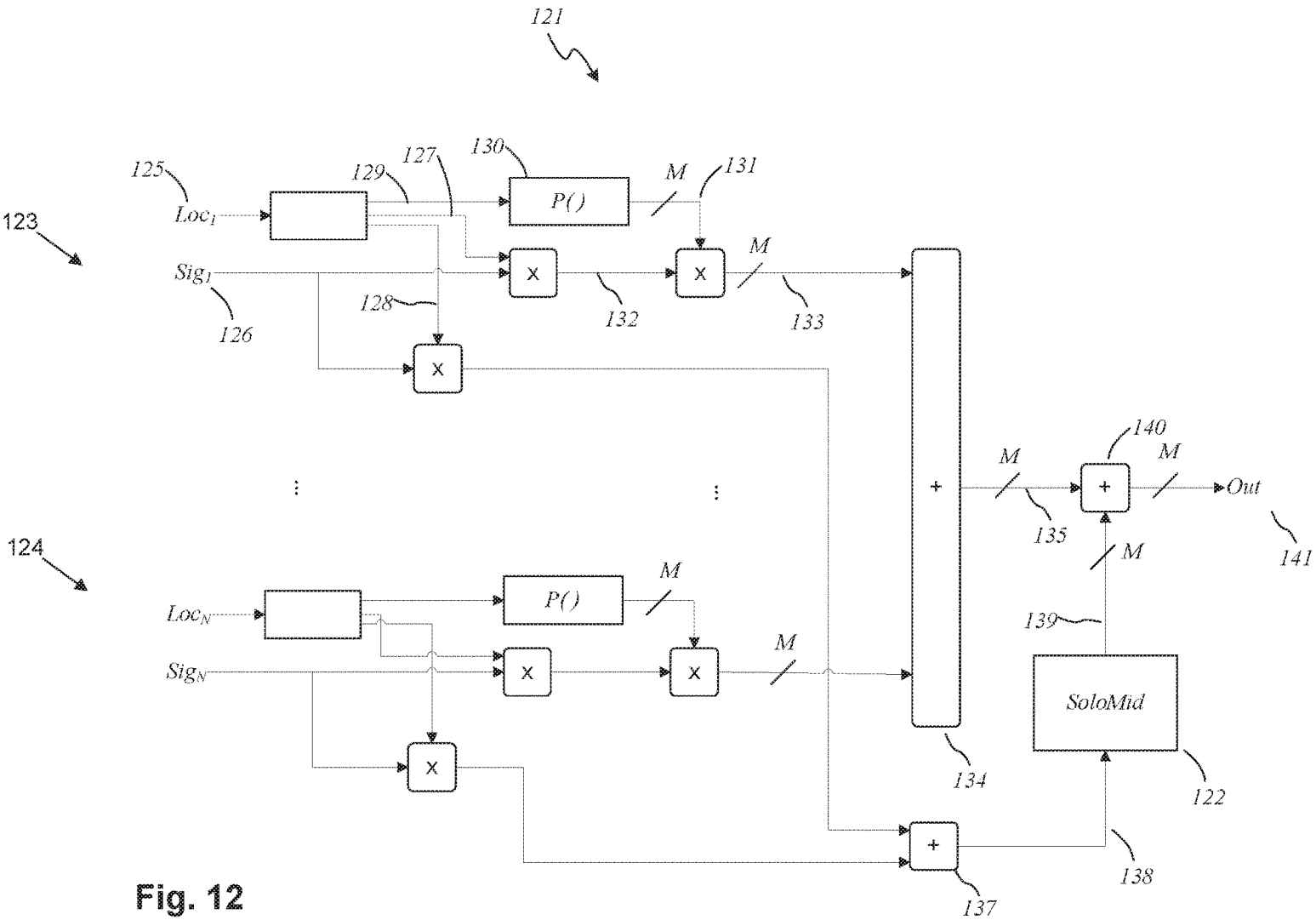
FIG. 12 illustrates the process of panning objects of an embodiment.

FIG. 12 illustrates a modified arrangement 121 which includes the utilisation of a SoloMid calculation unit 122. In this arrangement, which implements the form of calculation of the SoloMid function, the input consists of a series of audio objects e.g. 123, 124, In each of these signals the location information is input and split into wall 127 and SoloMid 128 panning factors, in addition to wall location 129. The wall location portion 129 is used to produce 130 the M speaker gain signals 131. These are modulated by the signal 132, which is calculated by modulating the input signal 126 by the wall factor 127. The output 133 is summed 134 with other audio objects to produce output 135.

The SoloMid signal for an object is calculated by taking the SoloMid factor 128 associated with the location of the object and using this factor to modulate the input signal 126. The output is summed with other outputs 137 to produce SoloMid unit input 138. The SoloMid unit 122 subsequently implements the SoloMid operation (described hereinafter) to produce M speaker outputs 139, which are added to the outputs 135 to produce overall speaker outputs 141.

Figure 13:
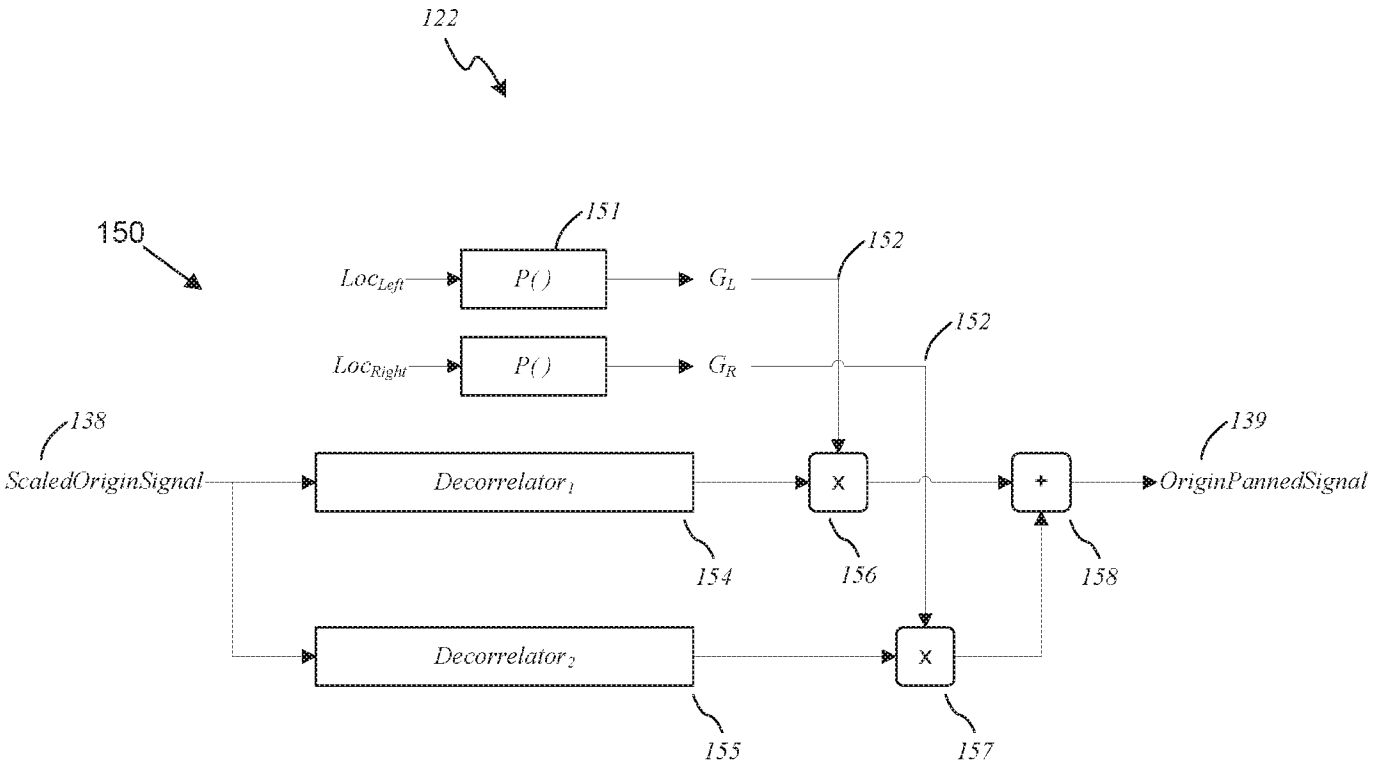
FIG. 13 illustrates schematically the SoloMid unit of FIG. 12.

FIG. 13 illustrates a first example version of the SoloMid unit 122 of FIG. 12. In this arrangement, the position of the left and right speakers are input 150 to corresponding panning units 151, which produce M-channel output gains 152, 153. The input scaled origin signal is fed to decorrelators 154, 155, which output signals to gain mulitpliers 156, 157. The M-channel outputs are then summed together 158 to form the M-channel output signal 139.

Figure 14:
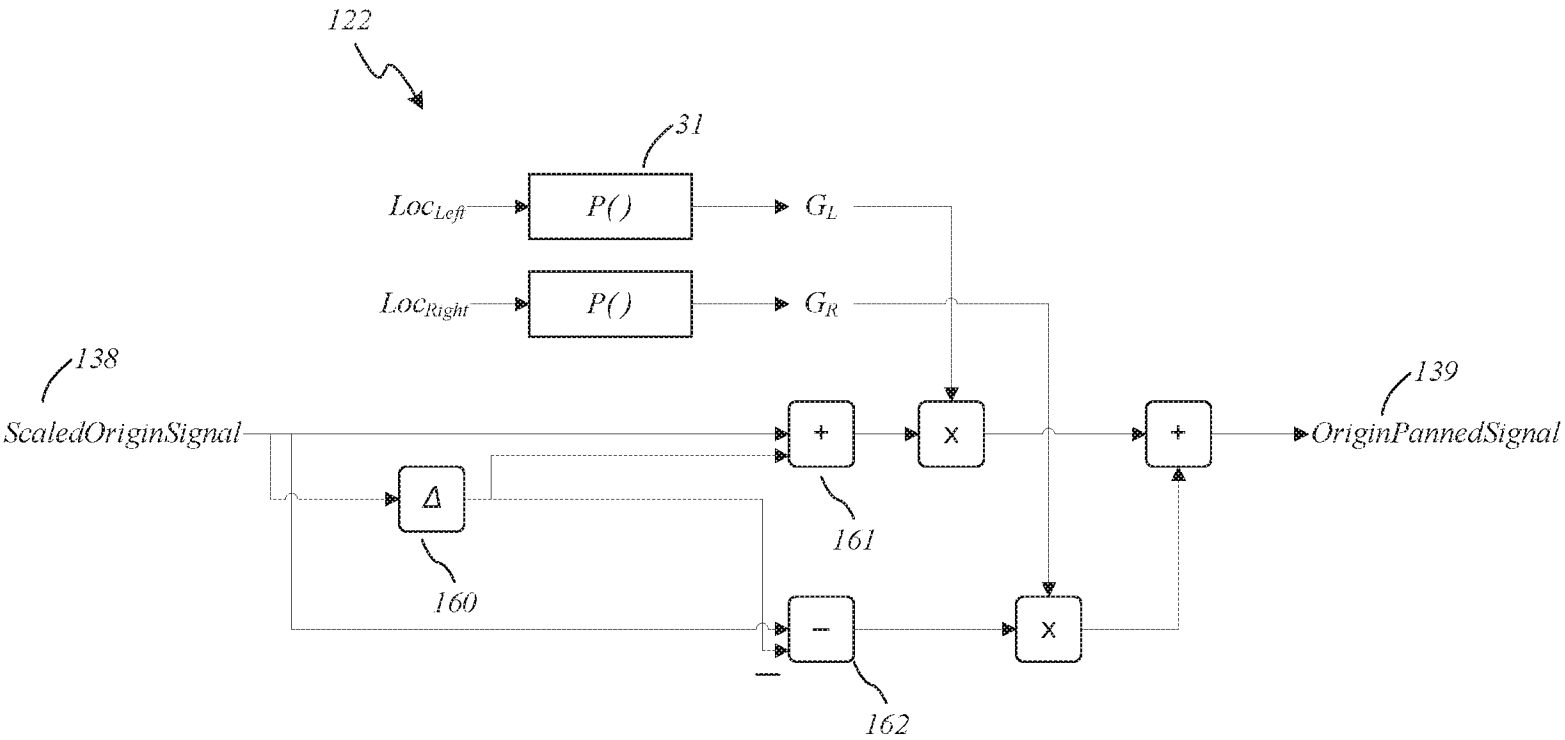
FIG. 14 illustrates a further alternative form of the SoloMid unit of FIG. 12.

FIG. 14 illustrates an alternative form of the SoloMid unit 122 which implements a simple decorrelator function. In this embodiment, a simple decorrelator function is performed by forming delayed version 160 of the input signal and forming sum 161 and difference 162 signal outputs of the decorrelator, with the rest of the operation of the SoloMid unit being as discussed with reference to FIG. 13.

Figure 15:
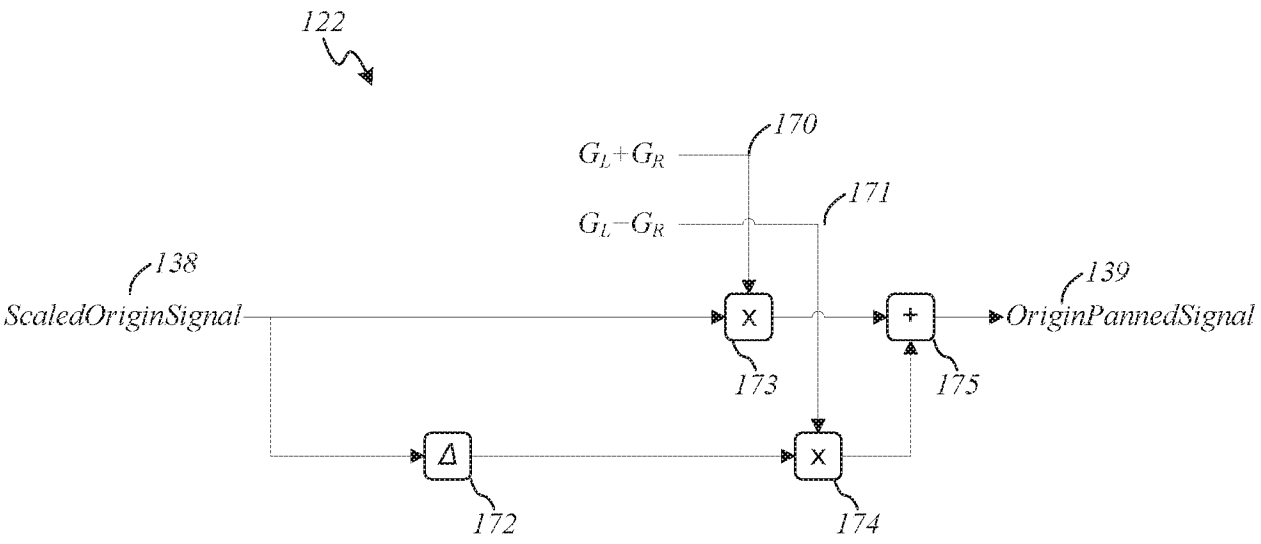
FIG. 15 illustrates a further alternative form the SoloMid unit of FIG. 12.

FIG. 15 illustrates a further alternative form of the SoloMid unit 122 wherein M-channel sum and difference panning gains are formed 170 and 171 and used to modulate 173, 174 the input signal 138 and a delayed version thereof 172. The two resultant M-channel signals are summed 175 before output. The arrangement of FIG. 15 providing a further simplification of the SoloMid process.

Figure 16:
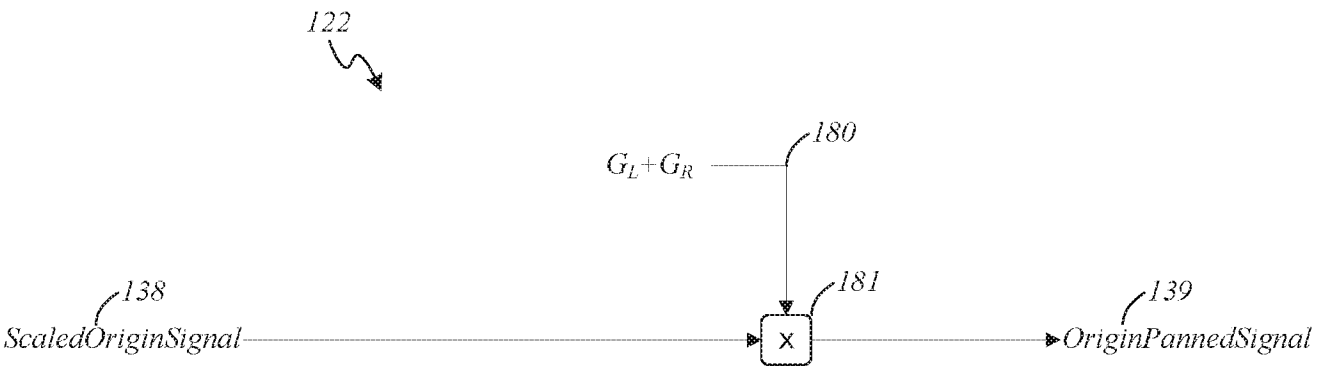
FIG. 16 illustrates a further alternative form of the SoloMid unit of FIG. 12.

FIG. 16 illustrates a further simplified alternative form of the SoloMid unit 122. In this arrangement, no decorrelation is attempted and the sum gains 180 are applied directly to the input signals to produce the M-channel output signal.

The processing for one object (for example 123) in FIG. 12 results in an M-channel wall-panned signal being fed to summer 134, and a single-channel Scaled Origin Signal being fed to summer 137. This means that the processing applied to a single object results in M+1 channels.

This process can be thought of in terms of a (M+1)×1 gain vector, where the additional channel is the Solo-Mid channel. This "extended" (M+1)×1 gain vector is returned by the AtmosXYZ_to_Pan( ) panning function.

The (M+1)×1 column vector returned by this function can be:

$$G_{ext} = \begin{pmatrix} g_{D,1} \times \sqrt{1 - DistToWall} \\ g_{D,2} \times \sqrt{1 - DistToWall} \\ \vdots \\ g_{D,M} \times \sqrt{1 - DistToWall} \\ \sqrt{DistToWall} \end{pmatrix} \quad (21)$$

where the gain values $g_{D,1} \ldots g_{D,M}$ are the individual elements of $G_D$ that are correspond to the panning gains for the wall-location (for example, 102 in FIG. 10).

This (M+1)×1 column vector simply provides the M gain values required to pan the Dolby Atmos object into the M Intermediate channels, plus 1 gain channel required to pan the Dolby Atmos object to the Solo-Mid channel. The Solo-Mid channel is then passed through the SoloMid process (as per 122 in FIG. 12) and before being combined 140 with the M intermediate channels to produce the output 141.

The embodiments provide for a method of panning audio objects to at least an intermediate audio format, where the format is suitable for subsequent decoding and playback. The audio objects can exist virtually within an intended output audio emission space, with panning rules, including panning to the center of the space, utilised to approximate a replication of the audio source.

Interpretation

Reference throughout this specification to "one embodiment", "some embodiments" or "an embodiment" means that a particular feature, structure or characteristic described in connection with the embodiment is included in at least one embodiment of the present invention. Thus, appearances of the phrases "in one embodiment", "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

As used herein, the term "exemplary" is used in the sense of providing examples, as opposed to indicating quality. That is, an "exemplary embodiment" is an embodiment provided as an example, as opposed to necessarily being an embodiment of exemplary quality.

It should be appreciated that in the above description of exemplary embodiments of the invention, various features of the invention are sometimes grouped together in a single embodiment, FIG., or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

Similarly, it is to be noticed that the term coupled, when used in the claims, should not be interpreted as being limited to direct connections only. The terms "coupled" and "connected," along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

Thus, while there has been described embodiments of the invention, those skilled in the art will recognize that other and further modifications may be made thereto without departing from the spirit of the invention, and it is intended to claim all such changes and modifications as falling within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

The invention claimed is:

1. A method of generating a multichannel audio signal comprising M channels, wherein each channel corresponds to a location on a surface, from at least one input audio object, wherein the at least one input audio object includes an audio object signal and an audio object location, the method comprising:

determining, in response to the audio object location, a first phantom object panning factor, a second phantom object panning factor, and a first phantom object location;

determining, for the audio object, a first phantom object signal and a second phantom object signal, wherein:

the first phantom object signal is located at the first phantom object location, and is determined by modulating the audio object signal by the first phantom object panning factor; and the second phantom object signal is located at a predetermined reference location, and is determined by modulating the audio object signal by the second phantom object panning factor;

determining M channels of a first phantom object component of the multichannel audio signal by applying a first panning operation to the first phantom object signal, wherein the first panning operation is responsive to the first phantom object location;

determining M channels of a second phantom object component of the multichannel audio signal by applying a predefined reference location panning operation to the second phantom object signal; and combining respective channels of the M channels of the first phantom object component of the multichannel audio signal with respective channels of the M channels of the second phantom object component of the multichannel audio signal to produce respective channels of the M channels of the multichannel audio signal.

2. The method of claim 1, wherein the predetermined reference location panning operation relies on one or more predetermined gain vectors.

3. The method of claim 2, wherein the predetermined reference location panning operation comprises applying a predetermined sum gain vector to the second phantom object signal to obtain the second phantom object component of the multichannel audio signal, wherein the predetermined sum gain vector represents a sum of a left gain vector and a right gain vector.

4. The method of claim 3, wherein the left gain vector is determined by mapping a left object location to a first location on the surface, and evaluating a panning function at the first location, the right gain vector is determined by mapping a right object location to a second location on the surface, and evaluating the panning function at the second location, the left object location corresponds to a location on a surface of a rectangular block volume substantially to the left of the predetermined reference location, and the right object location corresponds to a location on the surface of the rectangular block volume substantially to the right of the predetermined reference location.

5. The method of claim 2, wherein the predetermined reference location panning operation comprises applying one or more decorrelation processes to the second phantom object signal.

6. The method of claim 5, wherein one or more of the one or more decorrelation processes comprises applying a delay to the second phantom object signal.

7. The method of claim 5, wherein the predetermined reference location panning operation comprises:

applying a first decorrelation process to the second phantom object signal to obtain a first decorrelated signal;

applying a second decorrelation process to the second phantom object signal to obtain a second decorrelated signal;

applying a predetermined left gain vector to the first decorrelated signal to obtain a panned first decorrelated signal;

applying a predetermined right gain vector to the second decorrelated signal to obtain a panned second decorrelated signal; and combining the panned first decorrelated signal and the panned second decorrelated signal to obtain the second phantom object component of the multichannel audio signal.

8. The method of claim 5, wherein the predetermined reference location panning operation comprises:

applying a decorrelation process to the second phantom object signal to obtain a decorrelated signal;

determining a sum signal by adding the decorrelated signal to the second phantom object signal;

determining a difference signal by subtracting the decorrelated signal from the second phantom object signal;

applying a predetermined left gain vector to the sum signal to obtain a panned sum signal;

applying a predetermined right gain vector to the difference signal to obtain a panned difference signal; and combining the panned sum signal and the panned difference signal to obtain the second phantom object component of the multichannel audio signal.

9. The method of claim 5, wherein the predetermined reference location panning operation comprises:

applying a decorrelation process to the second phantom object signal to obtain a decorrelated signal;

applying a predetermined first gain vector to the second phantom object signal to obtain a panned second phantom object signal, wherein the predetermined first gain vector corresponds to a sum of a left gain vector and a right gain vector;

applying a predetermined second gain vector to the decorrelated signal to obtain a panned decorrelated signal, wherein the predetermined second gain vector corresponds to a difference of a left gain vector and a right gain vector; and combining the panned second phantom object signal and the panned difference signal to obtain the second phantom object component of the multichannel audio signal.

10. The method of claim 1, wherein the first panning operation comprises determining a first phantom object gain vector, and modulating the first phantom object signal by the first phantom object gain vector.

11. The method of claim 10, wherein the first phantom object location is substantially at an intersection of a surface of a rectangular block volume and a radial line through the predetermined reference point and the audio object location.

12. The method of claim 11, wherein determining the first phantom object gain vector comprises:

mapping the first phantom object location to a location on the surface; and evaluating a panning function at the location on the surface.

13. The method of claim 10, wherein the first phantom object location is substantially at an intersection of the surface and a radial line through the predetermined reference point and the audio object location.

14. The method of claim 13, wherein determining the first phantom object gain vector comprises evaluating a panning function at the first phantom object location.

15. The method of claim 1, wherein the surface comprises substantially a sphere or a rectangular block volume.

16. The method of claim 1, wherein the multichannel audio signal is generated from a plurality of input audio objects.

17. An audio signal processing device for generating a multichannel audio signal comprising M channels, wherein each channel corresponds to a location on a surface, from at least one input audio object, wherein the at least one input audio object includes an audio object signal and an audio object location, wherein the audio signal processing device:

determines, in response to the audio object location, a first phantom object panning factor, a second phantom object panning factor, and a first phantom object location;

determines, for the audio object, a first phantom object signal and a second phantom object signal, wherein:

the first phantom object signal is located at the first phantom object location, and is determined by modulating the audio object signal by the first phantom object panning factor; and the second phantom object signal is located at a predetermined reference location, and is determined by modulating the audio object signal by the second phantom object panning factor;

determines M channels of a first phantom object component of the multichannel audio signal by applying a first panning operation to the first phantom object signal, wherein the first panning operation is responsive to the first phantom object location;

determines M channels of a second phantom object component of the multichannel audio signal by applying a predefined reference location panning operation to the second phantom object signal; and combines respective channels of the M channels of the first phantom object component of the multichannel audio signal with respective channels of the M channels of the second phantom object component of the multichannel audio signal to produce respective channels of the M channels of the multichannel audio signal.

18. A non-transitory computer-readable storage medium comprising instructions which, when executed by an audio signal processing device, cause the audio signal processing device to perform a method of generating a multichannel audio signal comprising M channels, wherein each channel corresponds to a location on a surface, from at least one input audio object, wherein the at least one input audio object includes an audio object signal and an audio object location, the method comprising:

determining, in response to the audio object location, a first phantom object panning factor, a second phantom object panning factor, and a first phantom object location;

determining, for the audio object, a first phantom object signal and a second phantom object signal, wherein:

the first phantom object signal is located at the first phantom object location, and is determined by modulating the audio object signal by the first phantom object panning factor; and the second phantom object signal is located at a predetermined reference location, and is determined by modulating the audio object signal by the second phantom object panning factor;

determining M channels of a first phantom object component of the multichannel audio signal by applying a first panning operation to the first phantom object signal, wherein the first panning operation is responsive to the first phantom object location;

determining M channels of a second phantom object component of the multichannel audio signal by applying a predefined reference location panning operation to the second phantom object signal; and combining respective channels of the M channels of the first phantom object component of the multichannel audio signal with respective channels of the M channels of the second phantom object component of the multichannel audio signal to produce respective channels of the M channels of the multichannel audio signal.

* * * * *